US005221080A

United States Patent [19]

Ricciardi

[11] Patent Number: 5,221,080

[45] Date of Patent: Jun. 22, 1993

[54] STACKER ASSEMBLY HAVING VARIABLE PRESSURE STACKER PLATE

[75] Inventor: Mario Ricciardi, Glenview, Ill.

[73] Assignee: Bell & Howell Company, Skokie, Ill.

[21] Appl. No.: 837,054

[22] Filed: Feb. 18, 1992

[51] Int. Cl.[5] ..... B65H 31/14

[52] U.S. Cl. ..... 271/214; 271/2

[58] Field of Search ..... 271/2, 207, 210, 213-215, 271/217, 220, 221, 224

[56] References Cited

U.S. PATENT DOCUMENTS

| | | | |
|---|---|---|---|
| 2,853,298 | 9/1958 | Faeber | 271/210 |
| 3,139,278 | 6/1964 | Maidment | 271/214 |
| 3,865,365 | 2/1975 | Hardin et al. | 271/214 |
| 4,509,739 | 4/1985 | Kurokawa . | |
| 4,518,160 | 5/1985 | Lambrechts et al. | 271/214 |
| 4,524,965 | 6/1985 | Kulpa | 271/214 |
| 4,643,626 | 2/1987 | Noguchi et al. | 271/215 |
| 4,903,955 | 2/1990 | Manzke . | |
| 4,955,596 | 9/1990 | Ricciardi . | |
| 5,064,185 | 11/1991 | Ricciardi | 271/215 |
| 5,082,273 | 1/1992 | Matsumoto et al. | 271/215 |
| 5,104,109 | 4/1992 | Kubo | 271/215 |
| 5,116,039 | 5/1992 | Braen et al. | 271/2 |

*Primary Examiner*—Robert P. Olszewski
*Assistant Examiner*—Steven M. Reiss
*Attorney, Agent, or Firm*—Millen, White, Zelano & Branigan

[57] ABSTRACT

A stacker assembly for receiving generally flat documents, such as mailing envelopes and flats, in on-edge relation and maintaining the documents in upstanding side-by-side stacked relation as they accumulate in the stacker assembly. A receiving station is supported at one end of a horizontal support plate and guides successive incoming documents into stacked relation transverse to the longitudinal axis of the stacker assembly. A stacker plate is supported to engage the forwardmost document in the stack and is movable longitudinally of the stacker assembly in response to accumulation of documents in the stacker. Means in the form of a negator spring and a wedge plate cooperate with the stacker plate in a manner to apply a variable pressure against the documents so as to accommodate both thin lightweight and heavier documents in the stack while maintaining them in upstanding relation.

30 Claims, 2 Drawing Sheets

STACKER ASSEMBLY HAVING VARIABLE PRESSURE STACKER PLATE

BACKGROUND OF THE INVENTION

The present invention relates generally to stacker assemblies for use in document handling systems, and more particularly to a document stacker assembly having a novel variable pressure stacker plate.

Document handling or processing systems are generally known in which a plurality of documents, such as mailing envelopes and the like, are conveyed in serial upstanding on-edge relation from a feed magazine through one or more processing stations, and ultimately to one or more stacker stations after sorting. The stacker stations, alternatively termed stacker assemblies, receive the sorted documents in serial fashion and maintain them in upstanding on-edge stacked relation until removed for subsequent handling. See, for example, U.S. Pat. No. 4,955,596 which is incorporated herein by reference.

To maintain documents in upstanding stacked relation as they are fed into a stacker station, known stacker stations include vertically oriented stacker or pressure plates which engage the leading document in the stacker station and move progressively along the length of the stacker in response to successive documents fed into the stacker station. It is a common practice to apply a biasing force to the stacker or pressure plate so as to urge it against the stacked documents and maintain them in upstanding relation as the documents are fed into the stack from an in-feed conveyor or the like. If the stacker plate pressure is relatively light, thin documents, such as mailing envelopes on the order of 0.007 inch thick, can be readily introduced into the stacker. If the stacker plate pressure is too great, the thin mailing envelopes are prevented from readily entering the stacker and may jam at the entry into the stacker. If the stacker plate pressure is too light, heavier documents, such as mailing envelopes or flats up to 0.25 inch thick or greater, introduced into the stack at an early stage of stack buildup, may overcome the biasing force applied to the stacker plate and "kick" the plate rearwardly. This can result in the stacked documents falling to a substantially horizontal orientation with resultant malfunction of the stacker assembly. The present invention overcomes these problems by providing a stacker assembly having a stacker or pressure plate operative to support both lightweight and heavier documents fed into the stacker assembly.

SUMMARY OF THE INVENTION

One of the primary objects of the present invention is to provide a novel stacker assembly for use in a document processing system or the like, the stacker assembly including a stacker or pressure plate operative to maintain both relatively light and heavy documents in upstanding relation as they are fed into the stacker assembly while disposed in upstanding on-edge relation.

A more particular object of the present invention is to provide a novel stacker assembly for use in a document processing system or the like, wherein the stacker assembly includes a stacker or pressure plate adapted to engage the leading document of a plurality of documents fed sequentially into the stacker assembly while disposed in upstanding on-edge relation, the stacker plate being supported for movement to accommodate successive documents fed into the stack and being operative to apply a variable pressure against the stack so as to maintain both light and heavy documents in upstanding relation as they are fed into the stacker assembly.

A feature of the stacker assembly in accordance with the present invention lies in applying a first relatively light constant biasing force to the stacker or pressure plate throughout its full range of movement in response to documents fed into the stacker assembly, and causing the stacker plate to apply a second higher pressure against the stack of documents during predetermined initial movement of the stacker plate in response to documents fed into the stacker assembly.

Another feature of the stacker assembly in accordance with the present invention lies in establishing the higher initial pressure against documents fed into the stacker assembly by providing a ramp plate which cooperates with the stacker plate to resist initial rearward movement of the stacker plate in response to documents fed into the stacker assembly, thereby enabling the stacker plate to maintain both heavy and light documents in upstanding stacked relation as they are fed into the stacker assembly.

Further objects, features and advantages of the present invention, together with the organization and manner of operation thereof, will become apparent from the following detailed description when taken in conjunction with the accompanying drawings wherein like reference numerals designate like elements throughout the several views.

DETAILED DESCRIPTION OF THE DRAWINGS

Figure 1:
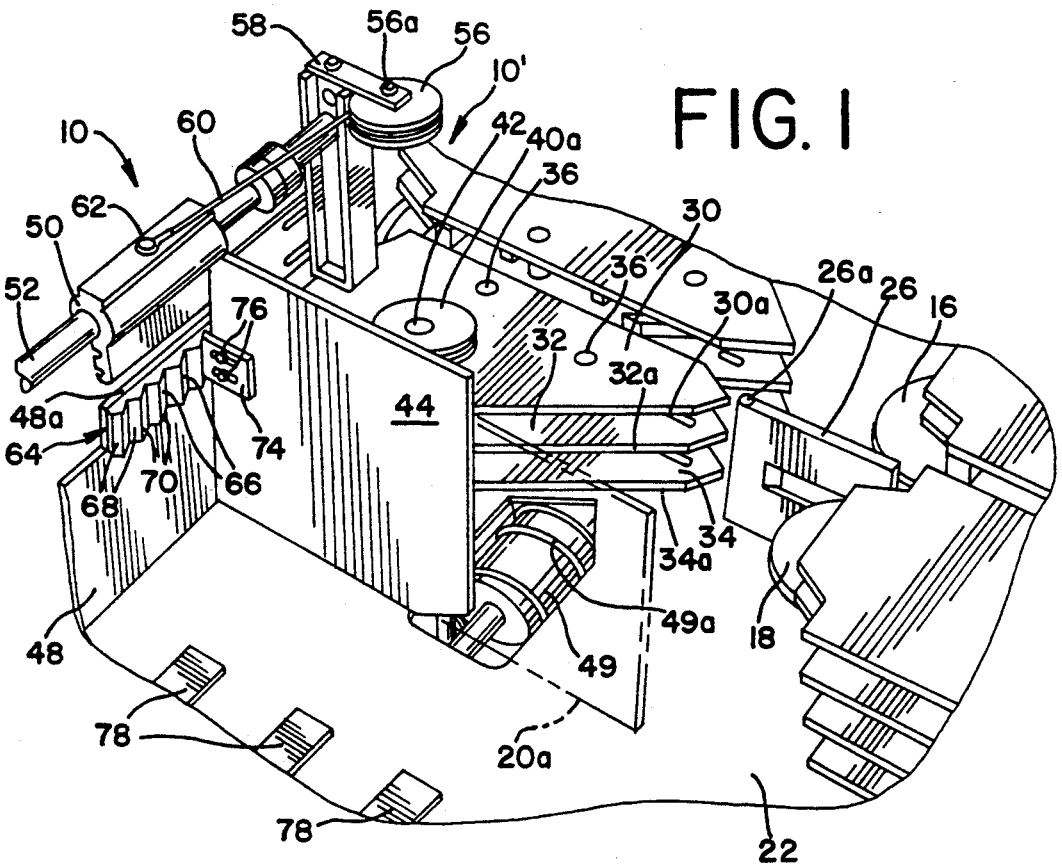
FIG. 1 is fragmentary perspective view of a stacker assembly constructed in accordance with the present invention.
Figure 2:
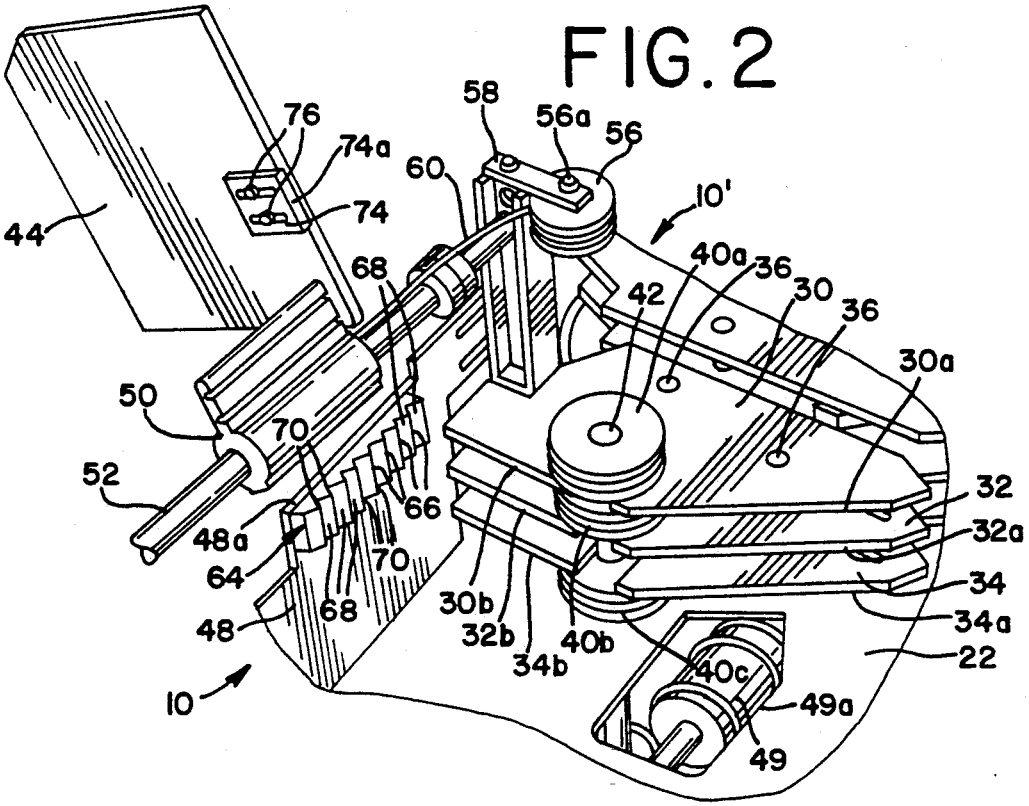
FIG. 2 is a fragmentary perspective view of a portion of the stacker assembly of FIG. 1 but with the stacker plate pivoted to an upward non-operative position to better illustrate the document receiving portion of the stacker assembly.
Figure 3:
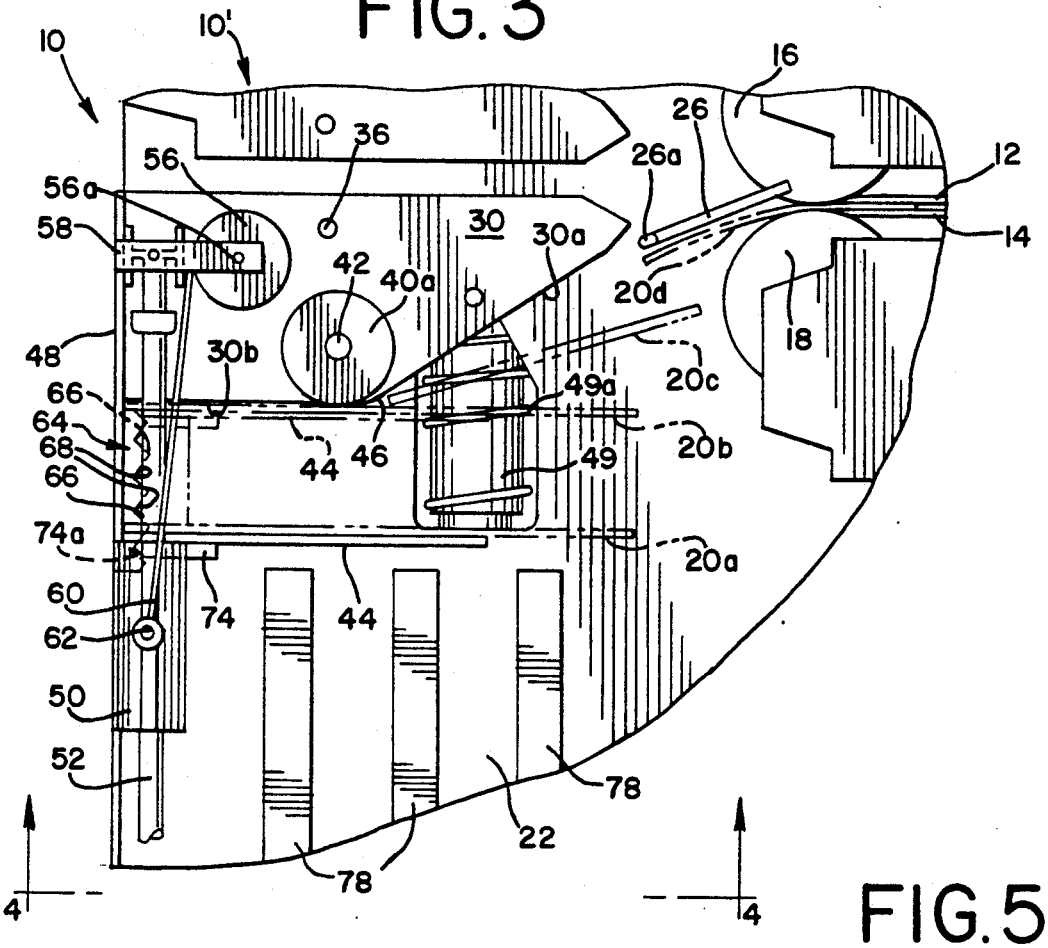
FIG. 3 is a fragmentary plan view of the stacker assembly of FIG. 1.

Referring now to the drawings, and in particular to FIGS. 1-3, a fragmentary portion of a document stacker assembly for use in a document handling system is indicated generally at 10. The stacker assembly 10, which may alternatively be termed a stacker station, is disposed downstream from a document processing or handling system (not shown) for processing documents, such as mailing envelopes or "flats". Such document handling or processing systems are commercially known which feed documents in generally upstanding on-edge relation from an input feeder station in singulated fashion to a downstream processing station such as a read station having alphanumeric or bar code reader means operative to read alphanumeric or bar code data on each successive document and effect movement of each document along a conveyor path to a selected one of a plurality of sorter stations. See, for example, the aforementioned U.S. Pat. No. 4,955,596.

Each sorter station may include a stacker assembly or station 10 constructed in accordance with the present invention.

In the illustrated embodiment, the stacker assembly 10 receives upstanding on-edge documents from the discharge end of a conveyor path defined in part by vertical reaches of endless flat conveyor belts, fragmentary portions of which are indicated at 12 and 14 in FIG. 3. The conveyor or feeder belts 12 and 14 are trained about suitable drive rollers and idler rollers, two of the latter being indicated at 16 and 18 for the respective conveyor belts 12 and 14, and are operative to convey documents, such as envelopes indicated in phantom at 20*a–d* in FIG. 3, in serial fashion along a predetermined conveyor path. A flat horizontal reach of a further conveyor belt (not shown) is preferably supported in generally coplanar relation with a support or base plate 22 of the stacker station 10 to underlie the lower edges of the conveyor belts 12 and 14 and support the bottom edges of documents being conveyed to the stacker assembly 10.

A diverter arm or plate 26 is supported on the base plate 22 for pivotal movement about a vertical pivot axis 26*a*. In the illustrated embodiment, the diverter arm 26 is operable through control means (not shown) to divert documents from the conveyor path of conveyor belts 12 and 14 to the stacker assembly 10, or to a similar stacker assembly, a portion of which is indicated 10' in FIG. 1, forming a generally mirror image with the stacker assembly 10.

Figure 4:
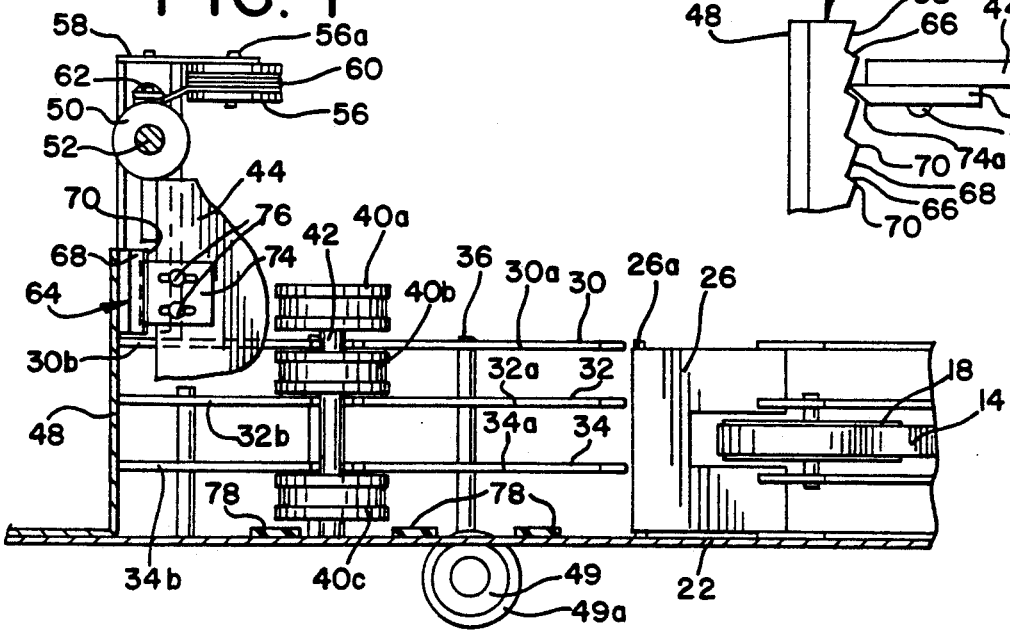
FIG. 4 is a fragmentary vertical sectional view taken substantially along line 4—4 of FIG. 3.
Figure 5:
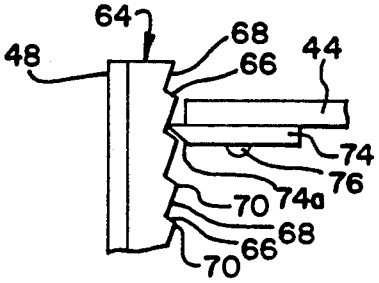
FIG. 5 is a fragmentary detail plan view, on an enlarged scale, illustrating the manner of cooperation between the ramp plate and stacker plate.

Assuming that the diverter arm 26 is pivoted to a position as shown in FIG. 3, a document, such as indicated at 20*c*, exiting from the conveyor belts 12 and 14 in upstanding on-edge relation is diverted by the diverter arm to the stacker assembly 10. The momentum of the diverted document causes it to engage coplanar guide surfaces 30*a*, 32*a* and 34*a* formed on horizontal plates 30, 32 and 34, respectively, which are maintained in vertical spaced relation to the base plate 22 by spacer sleeves 36 (FIG. 4). As will be described, the plates 30, 32 and 34 define a document receiving station operative to receive upstanding documents in successive order from the conveyor belts 14 and 16 and orient the documents to positions substantially transverse to the longitudinal axis of the stacker assembly 10. In the illustrated embodiment, the longitudinal axis of the stacker assembly 10 is substantially perpendicular to a vertical plane containing the conveyor path defined by the conveyor belts 12 and 14.

The guide surfaces 30*a*, 32*a* and 34*a* lie in a plane which is perpendicular to the base plate 22 and forms an included angle of approximately thirty degrees with the vertical plane containing the conveyor path defined by belts 14 and 16 adjacent their exit ends. The guide surfaces 30*a*, 32*a* and 34*a* intersect corresponding coplanar edge surfaces 30*b*, 32*b* and 34*b* formed on the plates 30, 32 and 34 and which lie in a plane perpendicular to the base plate 22 and substantially transverse to the longitudinal axis of the stacker assembly. Three coaxial stacker rollers or wheels 40*a*, 40*b* and 40*c* are mounted on a vertical drive shaft 42 which extends below the support plate 22 and is interconnected to rotary drive means (not shown) operative to enable selective rotation of the stacker rollers 40*a–c* in a clockwise direction, as considered in FIGS. 1–3. The rollers 40*a–c* have high friction outer peripheral surfaces which extend slightly outwardly from the plane of edge surfaces 30*b*, 32*b* and 34*b*. As will be more fully described, when beginning a document sorting operation, the stacker rollers 40*a–c* cooperate with a stacker or pressure plate, indicated generally at 44, to define a nip 46 (FIG. 3) which receives the vertical leading edge of each successive document directed by the diverter arm 26 along the guide surfaces 30*a*, 32*a* and 34*a*. The rotating stacker rollers feed each successive document to a position lying against the edge surfaces 30*b*, 32*b* and 34*b* with its leading edge abutting an upstanding side wall or guide plate 48 of the stacker assembly 10.

It will be understood that after the first document 20*a* is fed into the nip 46 defined between the stacker rollers 40*a–c* and the stacker plate 44, successive documents are fed into a nip defined between the stacker rollers 40*a–c* and the prior document fed into the stacker assembly. The upstanding side wall or guide plate 48 is normal to the base plate 22 and defines a guide or registration surface which extends parallel to the longitudinal axis of the stacker assembly 10 and is abutted by the leading edge of each document diverted to the stacker assembly 10 from the conveyor belts 12 and 14. A rotatably driven feed auger 49 is supported parallel to the longitudinal axis of the stacker assembly such that a raised spiral or helical feeder ridge 49*a* extends above the upper surface of the base plate 22. The feed auger 49 is positioned so that its helical ridge 49*a* engages the trailing bottom edge portion of each document, such as shown at 20*b* in FIG. 3, as its leading edge enters the nip 46. The feed auger moves the trailing portion of each successive document forwardly from the plane of the guide surfaces 30*a*, 32*a* and 34*a* so as to assure that the leading edge of each successive document will ride along these guide surfaces and not be blocked by the trailing edge of the preceding document.

The stacker or pressure plate 44 is generally rectangular and is fixed in transverse relation to a tubular sleeve 50 which is slidable along a cylindrical horizontal guide rod 52 supported parallel to the longitudinal axis of the stacker assembly 10 above the base plate 22, such as in generally vertically spaced relation above an upper horizontal edge 48*a* of the guide plate 48. The stacker plate 44 may thus move longitudinally along the guide rod 52 while maintained in transverse relation to the longitudinal axis of the stacker assembly.

The stacker assembly 10 as thus far described is of generally known construction and is operative to receive documents in upstanding on-edge relation from the conveyor path defined by conveyor belts 12 and 14 so that the documents are stacked in side-by-side relation between the coplanar edge surfaces 30*b*, 32*b* and 34*b* and the stacker plate 44 with the leading edges of the documents abutting the guide plate 48. When employed to stack relatively lightweight thin documents, such as mailing envelopes on the order of 0.007 inch thick, it is a common practice to bias the stacker plate against the documents entering the stacker assembly with sufficient force to maintain the envelopes in upstanding relation but without inhibiting rearward movement of stacker plate in response to entry of successive documents into the stacker station. In the illustrated embodiment, such biasing is provided by spring means in the form of a constant force rotary or reel type spring member 56 which is rotatably supported on a bracket 58 to overlie the upper plate 30. The spring member 56 has an elongated filament, such as a thin flexible wire 60, which is connected at one end to the rotary spring member and has its opposite end connected at 62 to the sleeve 50. The reel type spring member 56, which may be termed a negator spring, is biased in a clockwise rotational direction about its rotational axis 56*a* so as to apply a substantially constant longitudinal resistance force to the wire 60 as it is unwound from the reel of the spring member. In this manner, the wire 60 applies a substantially constant force on the sleeve 50 in a direction to bias the sleeve and stacker plate 44 toward the edge surfaces 30*b*, 32*b* and 34*b*. Stated alternatively, the constant force spring member 56 establishes a substantially constant force resisting movement of the stacker plate 44 away from the edge surfaces 30*b*, 32*b* and 34*b* on the plates 30, 32 and 34, respectively, and the associated stacker rollers 40*a–c*.

If the pressure applied by the stacker plate 44 against documents fed into the stacker assembly 10 due to the constant force spring member 56 is minimized, relatively thin lightweight documents, such as mailing envelopes in the order of approximately 0.007 inch thick, can be readily fed into the stacker assembly and maintained in upstanding stacked relation. If, however, the pressure applied by the stacker plate 44 against relatively thin lightweight documents fed into the stacker assembly is too great, the documents may jam at the nip 46. On the other hand, if the pressure applied by the stacker plate 44 is too low, heavier documents, such as mailing flats and envelopes up to one-quarter inch thick or greater, may overcome the biasing force of the negator spring 56 and force the stacker plate rearwardly along the guide rod 52 so that the documents fall to generally flat positions on the base plate 22 of the stacker assembly 10, rather than being maintained in upstanding stacked relation.

To overcome the aforedescribed problem of accommodating both thin lightweight and heavier thicker documents in an intermixed stack within the stacker assembly, the present invention provides additional biasing means cooperative with the stacker plate 44 so as to cause the stacker plate to apply a variable pressure against documents received in the stacker station between the edge surfaces 30*b*, 32*b* and 34*b* and the pressure plate. The additional biasing means cooperates with the negator spring wire 60 to cause the stacker or pressure plate 44 to apply an increased pressure or reaction force against the documents during initial build-up of a stack of documents in the stacker assembly 10 than would be applied by the negator spring itself. The increased or additional pressure or reaction force acts on the documents during a predetermined distance traversed by the stacker plate 44 as it is moved rearwardly along the guide rod 52 from a position immediately adjacent the stacker rollers 40*a–c* to a predetermined position spaced from the stacker rollers but less than the full distance traveled by the stacker plate during normal operation.

The aforedescribed increased pressure or reaction force applied by the stacker plate 44 is provided by wedge plate means in the form of a wedge plate 64 which, in the illustrated embodiment, is fixed to the upstanding guide plate 48 adjacent its top edge 48*a*. The wedge plate 64 is elongated and extends generally from the plane of the edge surfaces 30*b*, 32*b* and 34*b* of plates 30, 32, and 34, respectively, longitudinally along the guide plate 48 a predetermined distance, such as approximately 2–3 inches. The wedge plate 64 has a plurality of ramp surfaces 66 which lie in vertical planes and are outwardly inclined relative to the guide plate 48 so as to form included angles of incline of preferably about 45 degrees with the guide plate which runs parallel to the longitudinal axis of the stacker assembly 10. A planar return surface 68 is formed on the wedge plate between each adjacent pair of ramp surfaces 66. The return surfaces 68 lie in vertical planes which are inclined outwardly from the guide plate 48 at generally opposite angles of inclination to the ramp surfaces 66. The return surfaces 68 form included angles of preferably approximately 30 degrees with the guide plate 48, and thus the longitudinal axis of the stacker assembly. The ramp surfaces 66 are of equal size to each other, and the return surfaces 68 are of equal size to each other. Each ramp surface 66 and its associated return surface 68 intersect at a vertical line of intersection or apex, such as indicated at 70, such that the lines of intersection 76 lie in a common plane parallel to the guide plate 48. Preferably, the wedge plate 64 is made of a suitable plastic material so that the ramp surfaces 66 and return surfaces 68 establish relatively low-friction sliding surfaces.

The stacker plate 44 carries a wedge plate engaging member 74 which may be formed integral with or otherwise suitably secured to the stacker plate. In the illustrated embodiment, the wedge plate engaging member 74 is releasably and adjustably secured to the stacker plate 44 through a pair of screws 76 received through elongated slots in the wedge plate engaging member. The wedge plate engaging member 74 has a vertical height approximately equal to the height of the wedge plate 64 and has an angled outer end surface 74*a* which lies in a substantially vertical plane when the stacker plate 44 is in its normal operating position as shown in FIG. 1. The angled end surface 74*a* preferably forms an included angle with the plane of the stacker plate substantially equal to the angle of inclination of the ramp surfaces 66 with a plane transverse to the longitudinal axis of the stacker assembly. Stated alternatively, the angle of inclination of the end surface 74*a* relative to the plane of the stacker plate is selected such that such angle, plus the angle of inclination of the ramp surfaces 66 relative to the longitudinal axis of the stacker assembly, equals approximately 90 degrees. As noted, the angle of inclination of the ramp surfaces 66 relative to the guide plate 48 is preferably approximately 45 degrees so that the angle of inclination of the end surface 74*a* relative to the plane of the stacker plate is similarly approximately 45 degrees.

The ramp plate engaging member 74 is positioned relative to the stacker or pressure plate 44 so that with the end surface 74*a* of member 74 engaging the wedge plate 64, a lower or bottom edge 44*a* of the stacker plate is spaced slightly above the base plate 22. The weight of the stacker plate 44, its pivotal mounting on the guide rod 52, and the distance of the wedge plate engaging member 74 from the axis of guide rod 52, are selected such that a force is applied by the wedge plate engaging member 74 against the various ramp surfaces 66 to create a predetermined reaction force acting normal to the stacker plate in a direction resisting movement of the stacker plate longitudinally away from the edge surfaces 30*b*, 32*b* and 34*b* and the stacker rollers 40*a–c*. It will be appreciated that with each ramp surface 66 having an inclined angle of approximately 45 degrees with the longitudinal axis of the stacker assembly, and with the tangent of 45 degrees being unity, the reaction force created by the wedge plate in resisting rearward movement of the stacker plate will be approximately equal to the force applied to the ramp surface by the ramp plate engaging member 74. This force is a function of the weight of the stacker plate and the geometrical relation between the stacker plate, the axis of rod 52, and the position of stacker plate engaging member 74. It has been found that when stacking documents such as mailing envelopes or flats wherein the stack will include both relatively thin envelopes of approximately 0.007 inch thickness and thicker heavier envelopes having up to approximately one-quarter inch thickness or greater, and with the negator spring wire 60 applying a force of approximately 7 oz. on the stacker plate, obtaining a reaction force from the wedge plate 64 of approximately 8 oz. acting on the stacker plate in a direction resisting movement away from the stacker rollers 40*a–c* will result in requiring an average force of approximately 15 oz. to move the stacker plate rearwardly in response to initial entry of documents into the stacker assembly; that is, until the stacker plate has moved rearwardly past the wedge plate.

It will be appreciated that as documents enter the stacker assembly and overcome the movement-resisting force applied to the stacker plate by the wedge plate 64 and the negator spring member 56, the stacker plate progresses rearwardly along the various ramp surfaces 66 of the wedge plate in a step-like fashion. In this manner, as documents are initially fed into the stacker assembly, the stacker plate 44 applies a first force of approximately 15 ounces against the documents. The 15 oz. force continues during movement of the stacker plate along the wedge plate 64, such as a distance of approximately 2–3 inches. After incoming documents move the stacker plate 44 a distance greater than the length of the wedge plate 64, the force applied to the stacked documents is reduced to the spring force applied by the negator spring member 52. Stated alternatively, as documents are fed into the stacker assembly, initial movement of the stacker plate 44 from its position immediately adjacent the stacker rollers 40*a–c* is resisted by a first resistive force created by the negator spring member 56 and the reaction force between the wedge plate 64 and stacker plate 44. This force is sufficient to accommodate both relatively lightweight thin envelopes and thicker heavier envelopes or flats within the stacker assembly without the stacker plate being pushed rearwardly by the weight of the heavier envelopes in a manner allowing the envelopes to fall to relatively flat positions with consequent interruption of proper stacking of the documents.

As the documents accumulate in the stacker assembly 10 and force the stacker plate 44 rearwardly along the guide rod 52 to a position wherein the wedge plate engaging member 74 disengages from the wedge plate 64, resistance to movement of the stacker plate is reduced to the force applied by the negator spring member 56 which is sufficient to accommodate additional documents into the stacker assembly while maintaining them in upstanding stacked relation. Thus, the wedge plate 64 and negator spring member 56 establish a first movement-resisting force to the stacker plate during a predetermined length of travel responsive to documents fed into the stacker assembly, and establish a second movement-resisting force to the stacker plate during movement of the stacker plate along the support plate 22 a distance greater than the length of the wedge plate. The angle of incline of the return surfaces 68 on the wedge plate 64 is selected so that the force applied to the stacker plate by the negator spring wire 60 is sufficient to return the stacker plate to its initial position adjacent the stacker rollers 40*a–c* when the stacked documents are removed from the stacker assembly 10 preparatory to receiving and stacking further documents from the conveyor belts 12 and 14.

To facilitate sliding movement of the lower edge 44*a* of the stacker plate 44 along the base plate 22 after the wedge plate engaging member 74*a* has disengaged from the wedge plate 64, at least one elongated strip of low friction material is secured to the base plate 22 so as to extend longitudinally of the stacker assembly 10. In the illustrated embodiment, three strips of low friction material, such as strips 78 having upper nylon surfaces, are secured to the upper surface of base plate 22 to provide low friction surfaces along which the lower edge of the stacker plate slides during movement after release from the wedge plate 64.

While a preferred embodiment of the present invention has been illustrated and described, it will be understood that changes and modifications may be made therein without departing from the invention in its broader aspects. For example, while the invention has been described as having the wedge plate 64 supported in a generally vertical plane to engage the wedge plate engaging member 74 when disposed in substantially horizontal relation, the wedge plate 64 could be mounted on the base plate 22 with the ramp surfaces 66 and return surfaces 68 facing upwardly. In this case the wedge plate engaging member 74 would be mounted at a suitable position on the stacker plate to cooperate with the wedge plate in the aforedescribed manner.

Various features of the invention are defined in the following claims.

What is claimed is:

1. A stacker assembly for receiving generally flat documents in upstanding on-edge relation and maintaining the documents in upstanding side-by-side relation as they accumulate in a stack, said stacker assembly comprising, in combination; a substantially horizontal support plate defining a longitudinal axis, guide means extending longitudinally of said support plate and defining an upstanding guide surface for engagement by leading edges of documents fed to said stacker assembly, means defining a receiving station operative to receive upstanding on-edge documents in sequential order and guide the documents to predetermined positions on said support plate with said documents disposed substantially transverse to the longitudinal axis of said support plate with their leading edges generally engaging said guide surface, a stacker plate, means supporting said stacker plate in overlying relation to said support plate and generally transverse to the longitudinal axis thereof, said support means enabling movement of said stacker plate longitudinally of said support plate, said stacker plate being operative to engage the leading document of a succession of documents fed into said receiving station and being movable in response to entry of each successive document into the stacker assembly, and means cooperative with said stacker plate to apply a first pressure against documents during movement of said stacker plate a predetermined distance in response to documents fed into the stacker assembly, and apply a second pressure, different from said first pressure, against said documents during movement of said stacker plate a distance greater than said predetermined distance in response to documents fed into said stacker assembly.

2. A stacker assembly as defined in claim 1 wherein said stacker plate is movable longitudinally of said support plate from a first position adjacent said receiving station to a position spaced from said receiving station as documents are fed into the stacker assembly, said means cooperative with said pressure plate to apply pressure against said documents including first means operative to apply a substantially constant force on said stacker plate during its full range of movement in response to documents fed into the stacker assembly, and second means operative to increase the force acting on said stacker plate during movement of the stacker plate from said first position to a second position less than said full range of movement.

3. A stacker assembly as defined in claim 2 wherein said first constant force applying means includes spring means operative to apply a substantially constant force to said stacker plate throughout its full range of movement, and said second forcing increasing means includes a wedge plate which is engageable with said stacker plate in a manner to increase the pressure applied to said documents by said stacker plate as it is moved from said first position by documents fed into said stacker assembly.

4. A stacker assembly as defined in claim 3 wherein said wedge plate defines a plurality of ramp surfaces, said stacker plate including a wedge plate engaging member engageable with said ramp surfaces in a manner to create said increased pressure applied by said stacker plate.

5. A stacker assembly as defined in claim 4 wherein each of said ramp surfaces lies in a plane inclined at an angle of approximately 45 degrees with the longitudinal axis of said support plate.

6. A stacker assembly as defined in claim 4 wherein said ramp surfaces are planar and of equal size.

7. A stacker assembly as defined in claim 3 wherein said wedge plate defines a plurality of ramp surfaces engageable with the stacker plate in a manner to resist movement of said stacker plate from said first position to said second position in response to documents fed into the stacker assembly.

8. A stacker assembly as defined in claim 7 wherein said wedge plate further defines a return surface interposed between each adjacent pair of said ramp surfaces, said return surfaces enabling return of the stacker plate to a position adjacent said receiving station under the force of said spring means.

9. A stacker assembly as defined in claim 8 wherein said ramp surfaces lie in planes inclined at a first angle with the longitudinal axis of said support plate, said return surfaces being inclined in a generally opposite direction from said ramp surfaces at a second angle of incline with the longitudinal axis of the support plate which is of less magnitude than said first angle of incline.

10. A stacker assembly as defined in claim 9 wherein said first angle of incline of said ramp surfaces is approximately 45 degrees, and said second angle of incline of said return surfaces is approximately 30 degrees.

11. A stacker assembly as defined in claim 9 wherein said ramp surfaces and said return surfaces lie in planes perpendicular to said support plate.

12. A stacker assembly as defined in claim 8 wherein said stacker plate has a wedge plate engaging member having a contact surface adapted for sliding engagement with said ramp surfaces as said stacker plate is moved through said predetermined distance.

13. A stacker assembly as defined in claim 12 wherein said contact surface on said wedge plate engaging member lies in a plane inclined to said stacker plate at an angle substantially equal to the angle of incline between said ramp surfaces and a plane transverse to the longitudinal axis of said support plate.

14. A stacker assembly as defined in claim 1 wherein said guide means includes a generally upstanding guide plate extending longitudinally of said support plate and defining said guide surface for engaging leading edges of documents fed into the stacker assembly.

15. A stacker assembly as defined in claim 14 wherein said receiving station includes means cooperative with documents entering the receiving station to urge the leading edges of the documents against said guide surface.

16. A stacker assembly for receiving generally flat documents in upstanding on-edge relation and maintaining the documents in upstanding on-edge relation as they accumulate in a stack, said stacker assembly comprising, in combination; a substantially horizontal support plate defining a longitudinal axis, guide means extending longitudinally of said support plate and defining a registration surface for engaging leading edges of successive documents fed to said stacker assembly, means defining a receiving station operative to receive upstanding on-edge documents in sequential order and guide the documents to stacked positions substantially transverse to the longitudinal axis of said support plate with their leading edges engaging said registration surface, a stacker plate, means supporting said stacker plate generally transverse to the longitudinal axis of the support plate for movement in the direction of said longitudinal axis, said stacker being operative to engage the leading document of a succession of documents fed into said receiving station and being movable in response to entry of each successive document into the stacker assembly, and means cooperative with said stacker plate to establish a first force resisting movement of said stacker plate in response to documents fed into the stacker assembly as said stacker plate traverses a predetermined distance along said support plate, and establish a second smaller force resisting movement of said stacker plate a distance greater than said predetermined distance.

17. A stacker assembly as defined in claim 16 wherein said stacker plate is movable longitudinally of said support plate from a first position adjacent said receiving station to a position spaced from said first position as successive documents are fed into the stacker assembly, said resisting force establishing means including first means operative to apply a first substantially constant force to said stacker plat resisting movement thereof during its full range of movement in response to documents fed into the stacker assembly, and second means operative to establish a greater force resisting movement of the stacker plate from said first position to a second position less than said full range of movement.

18. A stacker assembly as defined in claim 17 wherein said first constant force applying means includes spring means operative to apply a substantially constant movement-resisting force to said stacker plate throughout its full range of movement, and wherein said second force establishing means includes a wedge plate engageable with said stacker plate in a manner to establish said greater movement resisting force.

19. A stacker assembly as defined in claim 18 wherein said wedge plate defines a plurality of ramp surfaces, said stacker plate being urged into engageable relation with said ramp surfaces by gravity.

20. A stacker assembly as defined in claim 19 wherein each of said ramp surfaces forms an included angle of approximately 45 degrees with the longitudinal axis of said support plate.

21. A stacker assembly as defined in claim 18 wherein said wedge plate defines a plurality of ramp surfaces cooperative with the stacker plate in a manner to resist movement of said stacker plate in response to documents fed into the stacker assembly, said wedge plate further defining a return surface interposed between each adjacent pair of ramp surfaces, said return surfaces enabling return of the stacker plate to a position adjacent said receiving station under the force of said spring means when no documents are disposed in said stacker assembly.

22. A stacker assembly as defined in claim 21 wherein said ramp surfaces each form a first angle of incline with the longitudinal axis of the support plate, each of said return surfaces forming a second angle of incline with the longitudinal axis of the support plate which is generally opposite to and less in magnitude than said first angle of incline.

23. A stacker assembly as defined in claim 22 wherein said first angle of incline is approximately 45 degrees, and said second angle of incline is approximately 30 degrees.

24. A method for maintaining a stack of documents in upstanding stacked relation as the stack expands longitudinally along a stacker assembly, said stacker assembly being of the type which has a longitudinal axis and includes means defining a receiving station operative to receive documents in sequential order and orient the documents in side-by-side relation transversely of the longitudinal axis, and a stacker plate disposed transverse to the longitudinal axis and operative to engage the forwardmost document and move progressively along the longitudinal axis in response to documents fed into the receiving station, said method comprising the steps of:

a. causing said stacker plate to apply a first pressure against stacked documents received in said receiving station as the documents accumulate a predetermined distance longitudinally along said stacker assembly, and b. causing said stacker plate to apply a second pressure, different from said first pressure, against the stacked documents as they accumulate along said stacker assembly a distance greater than said predetermined distance, said second pressure being less than said second pressure.

25. The method as defined in claim 24 wherein said step of causing said stacker plate to apply a second pressure against the stacked documents comprises applying a first force to said stacker plate resisting movement of the stacker plate along its full range of movement longitudinally along the stacker assembly, said first pressure being caused by applying a second force to said stacker plate which is additive to said first force in resisting movement of the stacker plate during accumulation of documents along said predetermined distance.

26. The method as defined in claim 25 wherein said step of applying said first force to said stacker plate comprises applying a substantially constant biasing force to said stacker plate resisting movement thereof throughout its full range of movement in response to stacked documents accumulated in said stacker assembly.

27. The method as defined in claim 26 wherein said step of applying said second force to said stacker plate comprises causing said stacker plate to engage a wedge plate during movement of said stacker plate along said predetermined distance, said wedge plate being operative to resist movement of the stacker plate in response to accumulation of documents along said predetermined distance of the stacker assembly.

28. The method as defined in claim 27 wherein said wedge plate includes a plurality of ramp surfaces angularly inclined to the longitudinal axis of the stacker assembly, said stacker plate having a wedge plate engaging member cooperative with said ramp surfaces to apply a predetermined force to the stacker plate resisting movement thereof in response to documents initially accumulating in the stacker assembly.

29. The method as defined in claim 28 wherein said ramp surfaces are each inclined at an angle of approximately 45 degrees with the longitudinal axis of the stacker assembly, said wedge plate engaging member having an angle of incline relative to the stacker plate such that a reaction force vector is established between each ramp surface and the stacker plate which is equal in magnitude to the force applied to the ramp surface by the stacker plate and acts in a direction substantially normal to the stacker plate.

30. The method as defined in claim 27 wherein said wedge plate includes a return surface intermediate each adjacent pair of ramp surfaces, said return surfaces being inclined to the longitudinal axis of the stacker assembly at an angle of incline opposite to and of less magnitude than the angle of incline of said ramp surfaces.

* * * * *